US005826996A

United States Patent [19]

Lee

[11] Patent Number: 5,826,996

[45] Date of Patent: Oct. 27, 1998

[54] TOP LOADING APPARATUS FOR A PRINTER

[75] Inventor: Yong-hyun Lee, Suwon, Rep. of Korea

[73] Assignee: Samsung Electronics Co., Ltd., Suwon, Rep. of Korea

[21] Appl. No.: 689,434

[22] Filed: Aug. 8, 1996

[30] Foreign Application Priority Data

Aug. 9, 1995 [KR] Rep. of Korea ..... 95-20553

[51] Int. Cl.[6] ..... B41J 13/10

[52] U.S. Cl. ..... 400/642; 400/645.4

[58] Field of Search ..... 400/623, 642, 400/645.3, 645.4, 595, 600

[56] References Cited

U.S. PATENT DOCUMENTS 1,024,759 4/1912 Woodward ..... 400/645.4

2,015,728 10/1935 Resch ..... 400/623

4,684,277 8/1987 Edstrom et al. ..... 400/462

*Primary Examiner*—Ren Yan

*Assistant Examiner*—Leslie Grohusky

*Attorney, Agent, or Firm*—Banner & Witcoff, Ltd.

[57] ABSTRACT

A top loading apparatus for use in a sheet feeding system for a printer is disclosed, wherein a finger which performs sheet loading is operated with a lever by user manipulation and is capable of elastic restoration. The apparatus comprises a lever rotatably mounted to a frame for moving at an angle of predetermined degree, torsion spring having its arms engagedly fixed to frame and lever, respectively, for supporting a restoration of level, a finger having its fixed arm rotatably and pivotally mounted to frame so that its free arm moves to load a sheet, and an elastic member which links frame and finger for allowing finger to be elastically restored when lever restores.

2 Claims, 4 Drawing Sheets

TOP LOADING APPARATUS FOR A PRINTER

CROSS-REFERENCE TO RELATED APPLICATIONS

This application makes reference to, incorporate the same herein, and claims all benefits accruing under 35 U.S.C. §119 by virtue of a patent application earlier filed in the Korean Industrial Proper Office on Aug. 9, 1995 entitled TOP LOADING DEVICE FOR USE WITH A PRINTER which was duly assigned Ser. No. 95-20553 by that office.

BACKGROUND OF THE INVENTION

1. Field of the Invention

The present invention relates in general to a top loading apparatus used in a printer such like an ink jet printer or laser printer and, more particularly, to an improved top loading apparatus and assembly therefor in which a finder for loading an individual sheet is arranged to operate by user manipulation of a lever and then to automatically return to its normal state by a restoring force. The apparatus is simplified in structure so that a failure of loading paper during auto sheet feeding is prevented.

2. Description of the Related Art

Generally, the well-known types of mechanisms for auto sheet feeding in a loading system for printers are either the detachable type or fixed type. Sheet loading failure seldom occurs in the detachable type mechanisms since a cassette is detached from, and then attached to, a frame of the printer so as to load a sheet by user manipulation, while frequent failures occur in the fixed type mechanisms.

Such fixed type mechanism are provided with a finger for feeding an individual sheet of paper to the body of a printer, and often a sheet is improperly fed or too many sheets are fed above a finger by virtue of a mistake of user manipulation. In that fixed type, however, the finger is normally actuated by a cam mechanism controlled with a photosensor during auto sheet feeding to prevent sheet feeding failure. This results in a complicated configuration, increased overhead and decreased product competitiveness.

SUMMARY OF THE INVENTION

Therefore, it is an object of the present invention to provide a top loading apparatus in which a finger for loading a sheet is arranged to be actuated by user manipulation of a lever and to return back to a normal state by an elastic restring force. It is an other object of the present invention to provide an improved top loading apparatus, which is simplified in structure but prevents a paper jam or misloading a sheet during a sheet feeding operation. This simplified structure is also capable of enhancing manufacturing productivity and thereby lowering cost. In order to accomplish the objects and advantages of the present invention, there is provided herein a top loading apparatus for use in an auto sheet feeding system for a printer.

The apparatus comprises a lever rotatably mounted to a frame of a printer to move at an angle of preset degrees, a torsion spring having one of its ends fixed to the frame and another end to the lever for elastically restoring the lever. The apparatus also comprises a finger having its fixed arm movably and rotatably mounted on the frame near the lever mount so that an arm on its free end for loading a sheet during an operation of lever and an elastic member connecting the frame and finger elastically to restore the finger to a normal location concurrent with the restoration of the lever, whereby sheet loading further is prevented by interlocking the lever with the finger during sheet feeding so a sheet cannot be misplaced on the finger.

A frame includes an inner sidewall lockup plate pivotally mounted by a hinge. The lockup plate is moved in response to a rotation of the lever to widen a gap between a free end of the lockup plate and a pickup roller, thus allowing sheet feeding. A guide slot in circular arc form is formed in the sidewall to allow the lever to move the lockup plate along the circular path when the lever is rotated about its pivot point.

An elastic body is connectedly inserted between the frame and the lockup plate so as to support the lockup plate in a normal pickup state. The lever comprises a semicircular body portion having a hole at substantially a center area for interlocking onto a pivot pin extended from the outer sidewall of the frame. When the lever is rotated about the pivot pin, a pushing step formed at one end of the body portion applies a pushing force to the finger. A handle is integrally formed with and protrudently extended from a peripheral sidewall of the body portion for allowing user manipulation and a guide protrusion is extended from a sidewall of the body portion toward the adjacent frame. The guide protrusion moves along the path of a guide slot in the frame, for pushing the lockup plate when the lever is rotated.

A torsion spring is mounted on the same pivot pin extended from the outer sidewall of frame on which the lever is mounted, a has its spring arms fixedly installed at spring protrusions extended from the outer sidewall of frame and a sidewall of the body portion of the lever, respectively. By both of its spring arms in this manner, the lever is maintained in a pickup status in its normal state.

A finger having its fixed arm rotatably installed to a finger pivot pin protrudently extends from the outer sidewall of frame is also provided with a pushing protrusion integrally formed with and protrudently extended from a location adjacent the fixed arm to cause its free arm to move within a preset angular range in response to a pushing force applied by the pushing step of the lever. An elastic member is arranged to be hooked to respective spring protrusions formed on the outer sidewall of the frame and on the body portion of the finger by its arms, so that an elastic spring force is applied to the finger in the direction of that spring's compression to cause the finger to return to its normal state. That is, the finger is biased toward the spring protrusion on the frame.

Description will hereunder be given of preferred embodiments of the present invention, with reference to the attached drawings.

DETAILED DESCRIPTION OF PREFERRED EMBODIMENTS

Figure 1:
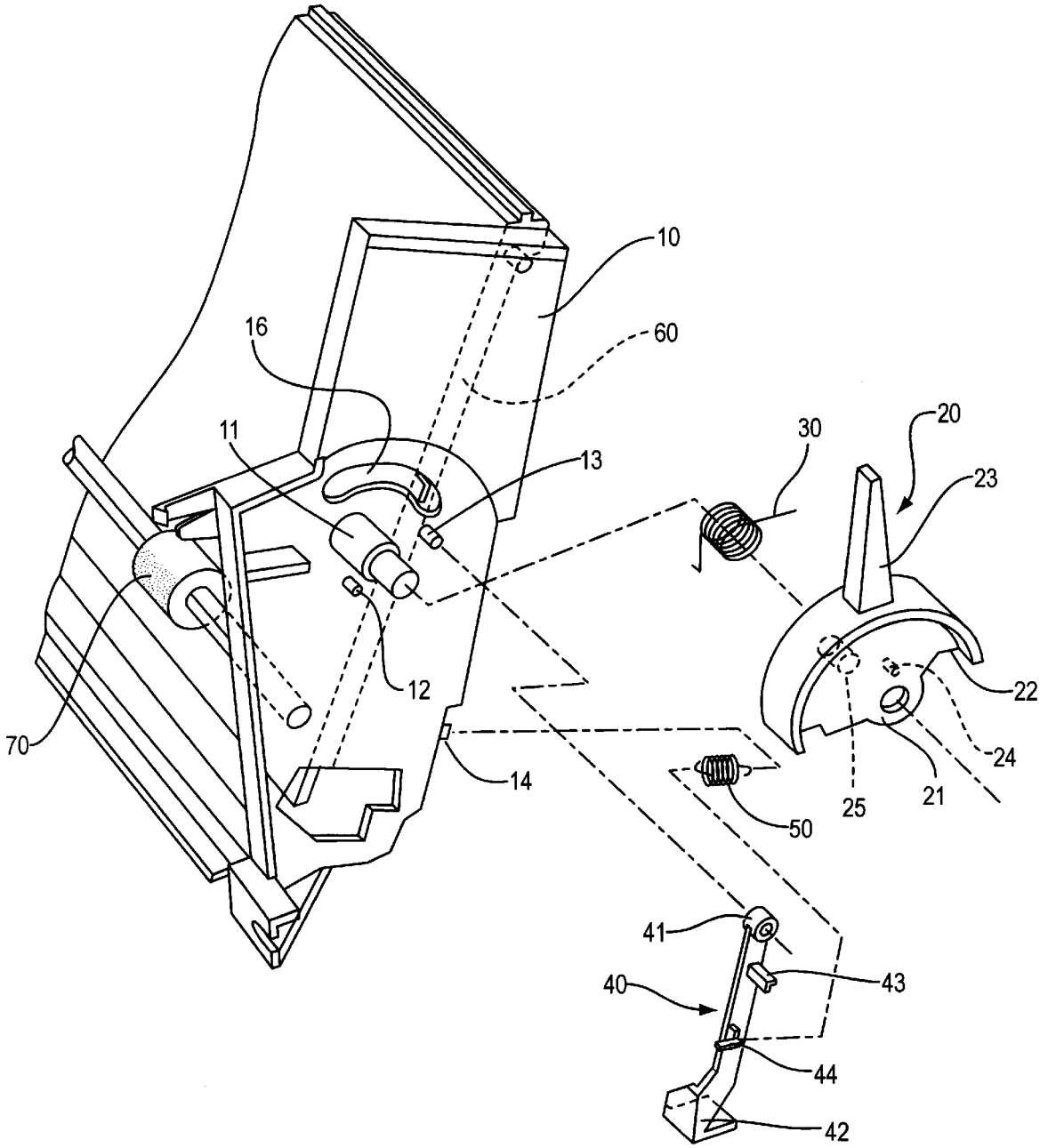
FIG. 1 is an exploded perspective view of a preferred embodiment according to the principles of the present invention, with parts removed for clarity.

Turning now to the drawings and referring specifically to FIGS. 1 to 4, an improved top loading apparatus for use in an auto sheet feeding system for a printer comprises a lever 20 pivotally mounted on and about a pivot point on frame 10 to rotate within a predetermined angular range, a torsion spring 30 having its arms fixed on respective spring protrusions formed on both lever 20 and frame 10 so as to elastically cause lever 20 to automatically return to its normal position, a finger 40 having its fixed arm 41 pivotally and rotatably mounted to frame 10 such that during an operation of lever 20, free arm 42 moves to enable sheet loading and an elastic member 50 elastically linking frame 10 and finger 40 is biased to cause finger 40 to return to its normal position concurrent with the return of lever 20.

Frame 10 is provided with hinge 15 positioned on the surface of one sidewall to which lockup plate 60 is rotatably and pivotally installed. Lockup plate 60 is pushed by lever 20 during rotational movement operation of lever 20 about pivot pin 11. Elastic body 80 is installed between frame 10 and lockup plate 60 for supporting the maintenance of pickup status of lockup plate 60. Lever 20 comprises a body portion 21 having a hole at substantially a center area of its sidewall to receive pivot pin 11 for engagedly interlocking therewith so as to allow rotational operation thereof, a pushing step 22 integrally formed at an end of body portion 21 for bearing against finger 40, a handle 23 integrally formed with and extended outwardly from the surface of a peripheral sidewall of body position 21 for allowing user manipulation and a guide protrusion 25 extended toward the frame from the bottom surface of body portion 21, the guide or protrusion engaging and moving along the path of guide slot 16 formed in frame 10, to thereby push lockup place 60 during rotational operation of lever 20.

Torsion spring 30 is first mounted on pivot pin 11 on frame 10 and then is fixedly coupled to spring protrusions 12 and 24 respectively extended from the sidewalls of both frame 10 and lever 20 by its arms, causing lever 20 to maintain a normal pickup status and allowing its elastic restorative force to increase during sheet feeding. Finger 40 has its fixed arm 41 rotatably and pivotally installed to finger pivot pin 13 formed on frame 10. Finger 10 is provided with a pushing protrusion 43 integrally formed on a location of the body position adjacent to fixed arm 41, and has its free arm 42 movable in an angular range of predetermined degrees by a pushing force applied by pushing step 22 of lever 20 bearing against pushing protrusion 43.

Elastic member 50 has its arms mounted on spring protrusions 14 and 44 formed on frame 10 and finger 40, respectively. Finger 40 extends elastic member 50 elastically during an operation of sheet loading, and the finger is restored to its normal position by the elastic spring force of member 50 which is biased in the direction of closing up both arms. Here, an elastic spring is used in this particular preferred embodiment for an exemplary purpose, however, any elastic body having same property of nature as elastic spring will do.

Figure 2:
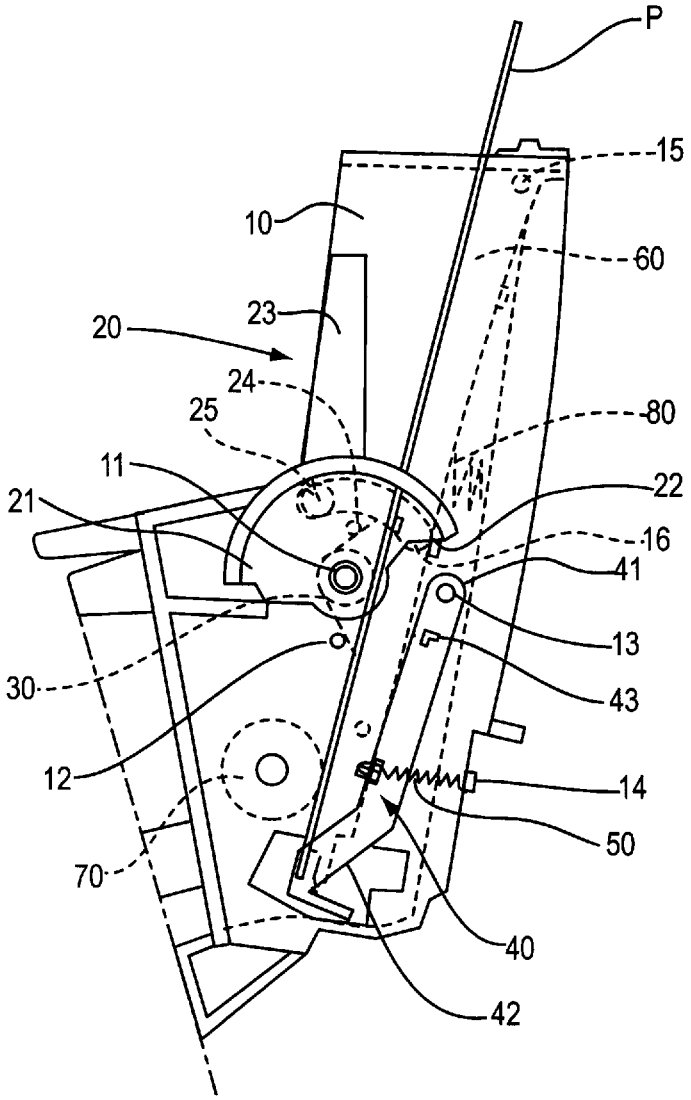
FIG. 2 is a cross-sectional elevation view illustrating a pickup operational status of the preferred embodiment of FIG. 1.
Figure 3:
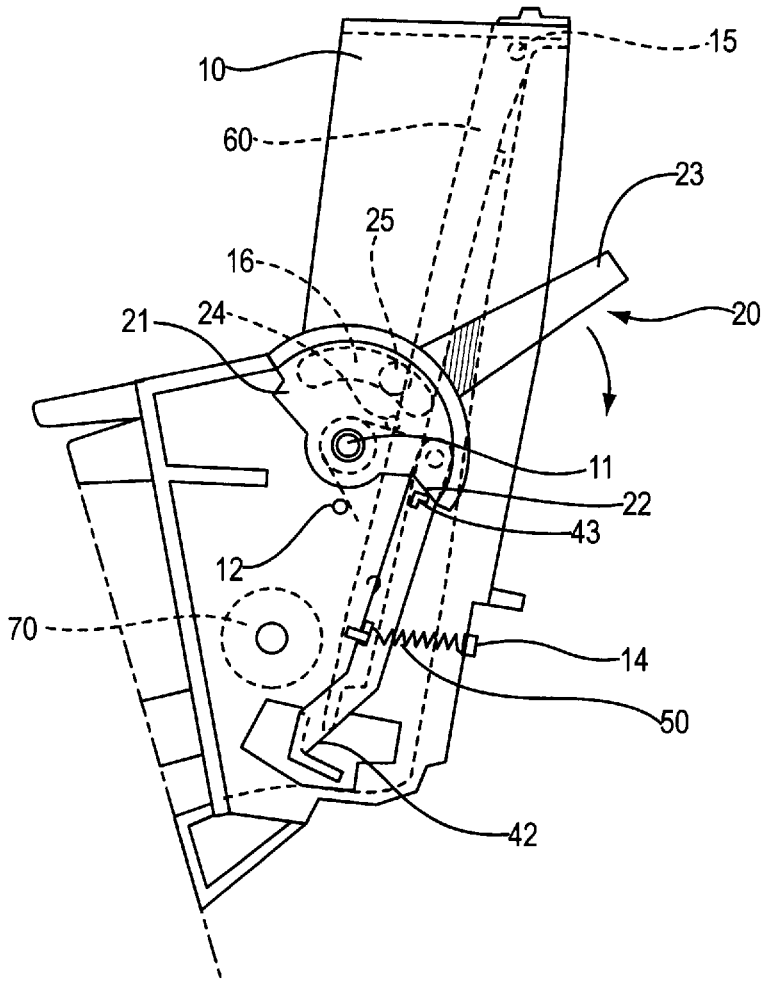
FIG. 3 and FIG. 4 are crosssectional elevation views, respectively, illustrating a sheet loading operation of the preferred embodiment of the present invention.

In more detail, and with reference to FIG. 2, lever 20 and finger 40 are arranged to be located to maintain respective normal pickup status by virtue of torsion spring 30 and elastic member 50. When handle 23 is turned clockwise around pivot pin 11 by user manipulation, as illustrated in FIG. 3, so as to load a sheet, then pushing step 22 of lever 20 moves to contact pushing protrusion 43 and, in turn, torsion spring 30 is pressed in the direction of closing up its aims. Guide protrusion 25 formed on lever 20 moves along the path of guide slot 16 formed in frame 10 and simultaneously pushes a portion of lockup plate 60 to cause lockup plate 60 to rotate about its hinge 15. This causes the free end of lockup plate 60 to separate from pickup roller 70 gradually, and in turn, increases the elastic spring force of elastic body 80.

Figure 4:
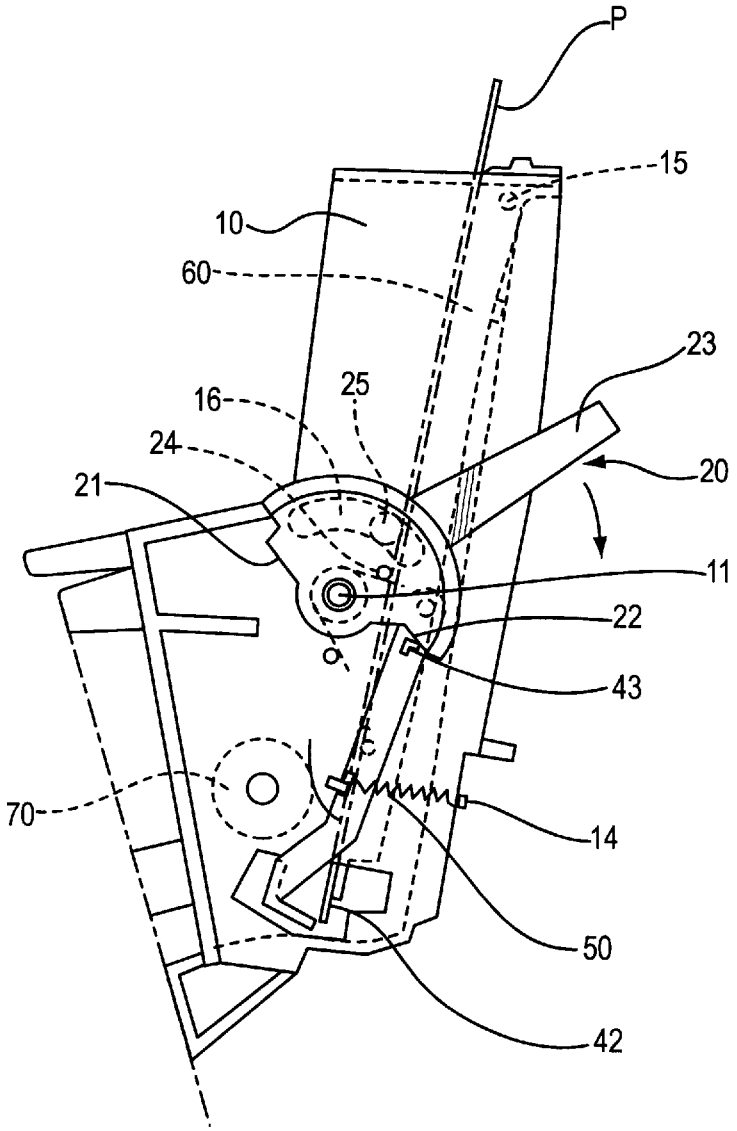

Then, as shown in FIG. 4, pushing protrusion 43 of finger 40 is further pushed by pushing step 22 of lever 20 under continued rotational operation of lever 20, causing fixed arm 41 to rotate about finger pivot pin 13 and, in turn, causes free arm 42 to move around with the predetermined angular range thereby allowing sheets to be fed. At that moment, torsion spring 30 is more elastically compressed while elastic member 50 is extended. Consequently, guide protrusion 24 on lever 20 keeps moving along guide slot 16 to push harder on lockup plate 60, thereby causing the gap created between free arm of lockup plate 60 and pickup roller 70 to become wider to facilitate the sheet feeding operation.

Upon completion of the sheet feeding operation, the externally applied pulling force applied to lever 20 by the user is removed so the finger 40 is restored to a normal pickup state. Then lever 20 and finger 40 turn counterclockwise, respectively, by the elastic force of torsion spring 30 and that of elastic member 50. Lockup plate 60 is restored to its normal state by the elastic spring force of elastic body 80 under pressure so as to cause pickup roller to closely contact a sheet. As a result, lever 20 and finger 40 are constructed to interlock with each other during the sheet feeding operation, simplifying its structure to avoid any misplacement of a sheet on finger 40, preventing any failure of auto sheet feeding, thereby enhancing product reliability, at a low cost. A sheet of paper is labeled P in FIGS. 2 and 4.

From the foregoing detailed descriptions it will be evident that there are a number of changes, adaptations, and modifications of the present invention which come within the province of those skilled in the an- However, it is intended that all such variations not departing from the spirit of the invention be considered as within the scope thereof as limited solely by the claims appended hereto.

What is claimed is:

1. A top loading apparatus for use in a sheet feeding system for a printer having a frame, said apparatus comprising:

a lever rotatably mounted on the frame for movement within a predetermined angular range from a first position to a second position, said lever comprising a body portion rotatably mounted to the frame by a pivot pin provided on the frame, a pushing step integrally formed on said body portion for contacting and pushing said finger, and a handle integrally formed with and extending protrudently from said body portion for enabling manual actuation;

a torsion spring having one arm fixed to the frame and another arm fixed to said lever for exerting a restoring force on said lever to return to said first position when said lever is moved manually to said second position and released;

a finger having a fixed end rotatably mounted to the frame and a free end movable within a predetermined angular range in response to movement of said lever for enabling sheet loading; and a biasing member liking said finger to the frame and biasing said finger in a first position and for exerting a restoring force on said finger to return to said first position concurrent with the return of said lever to its first position.

2. A top loading apparatus for use in a sheet feeding system for a printer having a frame, said apparatus comprising:

a lever rotatably mounted on the frame for movement within a predetermined angular range from a first position to a second position;

a torsion spring having one arm fixed to the frame and another arm fixed to said lever for exerting a restoring force on said lever to return to said first position when said lever is moved manually to said second position and released;

a finger having a fixed end rotatably mounted to the frame by a finger pivot pin provided on the frame and a free end movable within a predetermined angular range in response to movement of said lever for enabling sheet loading, wherein said finger comprises a pushing protrusion integrally formed adjacent to said fixed end for engaging said lever which is adapted to bear against said pushing protrusion to thereby move said free end; and a biasing member linking said finger to the frame and biasing said finger in a first position and for exerting a restoring force on said finger to return to said first position concurrent with the return of said lever to its first position.

* * * * *